US009629391B2

(12) United States Patent
Dube et al.

(10) Patent No.: US 9,629,391 B2
(45) Date of Patent: Apr. 25, 2017

(54) TOBACCO-DERIVED PYROLYSIS OIL

(71) Applicant: R.J. REYNOLDS TOBACCO COMPANY, Winston-Salem, NC (US)

(72) Inventors: Michael Francis Dube, Winston-Salem, NC (US); Anthony Richard Gerardi, Winstom-Salem, NC (US); Christopher Junker, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 843 days.

(21) Appl. No.: 13/962,298

(22) Filed: Aug. 8, 2013

(65) Prior Publication Data

US 2015/0040922 A1 Feb. 12, 2015

(51) Int. Cl.

| | |
|---|---|
| ***A24B 15/18*** | (2006.01) |
| ***A24B 15/28*** | (2006.01) |
| ***A24B 15/30*** | (2006.01) |
| *A24F 47/00* | (2006.01) |

(52) U.S. Cl.

CPC ..... *A24B 15/18* (2013.01); *A24B 15/28* (2013.01); *A24B 15/302* (2013.01); *A24F 47/008* (2013.01)

(58) Field of Classification Search

USPC ..... 131/275, 311, 329, 347, 352, 359

See application file for complete search history.

(56) References Cited

U.S. PATENT DOCUMENTS

| | | | | |
|---|---|---|---|---|
| 3,106,473 A | | 10/1963 | Hollenbeck et al. | |
| 3,330,669 A | | 7/1967 | Hollenbeck | |
| 3,424,171 A | | 1/1969 | Rooker | |
| 3,476,118 A | | 11/1969 | Luttich | |
| 4,150,677 A | | 4/1979 | Osborne | |
| 4,244,381 A | | 1/1981 | Lendvay | |
| 4,256,123 A | * | 3/1981 | Lendvay | A24B 15/165 131/369 |
| 4,596,259 A | | 6/1986 | White et al. | |
| 4,793,365 A | | 12/1988 | Sensabaugh, Jr. et al. | |
| 4,986,286 A | | 1/1991 | Roberts et al. | |

(Continued)

FOREIGN PATENT DOCUMENTS

| | | |
|---|---|---|
| CN | 102408410 | 4/2012 |
| CN | 102899069 | 1/2013 |

(Continued)

OTHER PUBLICATIONS

"What is Flash Chromatography", Labhut.com, 2016, [online], Retrieved from the Internet, [retrieved Jun. 7, 2016], <URL:http://www.labhut.com/education-centre/flash-chromatography/what-is-flash-chromatography.html>.*

(Continued)

*Primary Examiner* — Dennis Cordray

(74) *Attorney, Agent, or Firm* — Womble Carlyle Sandridge & Rice, LLP

(57) ABSTRACT

The present disclosure provides tobacco-derived pyrolysis oils and derivatives thereof, such as isolated components and mixtures obtained from such pyrolysis oils. Advantageously, the tobacco-derived pyrolysis oils disclosed herein can exhibit desirable sensory characteristics. Further, tobacco-derived pyrolysis oils disclosed herein can exhibit desirably low concentrations of benzo[a]pyrene. The disclosure also provides methods for obtaining such tobacco-derived pyrolysis oils and derivatives thereof.

34 Claims, 3 Drawing Sheets

(56) References Cited

U.S. PATENT DOCUMENTS

| | | | |
|---|---|---|---|
| 5,074,319 | A | 12/1991 | White et al. |
| 5,099,862 | A | 3/1992 | White et al. |
| 5,101,839 | A | 4/1992 | Jakob et al. |
| 5,235,992 | A | 8/1993 | Sensabaugh, Jr. |
| 5,301,694 | A | 4/1994 | Raymond |
| 5,538,018 | A | 7/1996 | Chan et al. |
| 6,048,404 | A | 4/2000 | White |
| 6,298,858 | B1 | 10/2001 | Coleman, III et al. |
| 6,325,860 | B1 | 12/2001 | Coleman, III |
| 6,428,624 | B1 | 8/2002 | Coleman, III et al. |
| 6,440,223 | B1 | 8/2002 | Dube et al. |
| 6,499,489 | B1 | 12/2002 | Coleman, III |
| 6,591,841 | B1 | 7/2003 | White et al. |
| 7,025,066 | B2 | 4/2006 | Lawson et al. |
| 8,061,362 | B2 | 11/2011 | Mua et al. |
| 8,434,496 | B2 | 5/2013 | Chen et al. |
| 2002/0162563 | A1 | 11/2002 | Williams |
| 2003/0070687 | A1 | 4/2003 | Atchley et al. |
| 2004/0020503 | A1 | 2/2004 | Williams |
| 2004/0173228 | A1 | 9/2004 | Coleman, III |
| 2005/0178398 | A1 | 8/2005 | Breslin et al. |
| 2006/0191548 | A1 | 8/2006 | Strickland et al. |
| 2007/0062549 | A1 | 3/2007 | Holton, Jr. et al. |
| 2007/0186941 | A1 | 8/2007 | Holton, Jr. et al. |
| 2007/0186942 | A1 | 8/2007 | Strickland et al. |
| 2007/0193596 | A1 | 8/2007 | Mori et al. |
| 2008/0029110 | A1 | 2/2008 | Dube et al. |
| 2008/0029116 | A1 | 2/2008 | Robinson et al. |
| 2008/0029117 | A1 | 2/2008 | Mua et al. |
| 2008/0173317 | A1 | 7/2008 | Robinson et al. |
| 2008/0209586 | A1 | 8/2008 | Nielsen et al. |
| 2008/0254149 | A1 | 10/2008 | Havkin-Frenkel |
| 2009/0025739 | A1 | 1/2009 | Brinkley et al. |
| 2010/0037903 | A1 | 2/2010 | Coleman, III et al. |
| 2011/0034712 | A1 | 2/2011 | Lin et al. |
| 2011/0174323 | A1 | 7/2011 | Coleman, III et al. |
| 2011/0247640 | A1 | 10/2011 | Beeson et al. |
| 2011/0259353 | A1 | 10/2011 | Coleman, III et al. |
| 2012/0037175 | A1 | 2/2012 | Cantrell et al. |
| 2012/0125354 | A1 | 5/2012 | Byrd et al. |
| 2012/0152265 | A1 | 6/2012 | Dube et al. |
| 2012/0192880 | A1 | 8/2012 | Dube et al. |
| 2012/0192882 | A1 | 8/2012 | Dube et al. |
| 2012/0211016 | A1 | 8/2012 | Byrd, Jr. et al. |
| 2012/0241305 | A1 | 9/2012 | Goldberg et al. |
| 2013/0008457 | A1 | 1/2013 | Zheng et al. |
| 2013/0037041 | A1 | 2/2013 | Worm et al. |
| 2013/0255702 | A1 | 10/2013 | Griffith, Jr. et al. |

FOREIGN PATENT DOCUMENTS

| | | |
|---|---|---|
| JP | 1162008 | 10/1997 |
| WO | WO 2008/128355 | 10/2008 |
| WO | WO 2009/110775 | 9/2009 |

OTHER PUBLICATIONS

Baliga et al., "Physical characterization of Pyrolyzed Tobacco and Tobacco Components," *J. anal. Appl. Pyrolysis*, 2003, pp. 191-215, vol. 66.

Hall et al., Quantitative Analysis of Cellulose in Tobacco by 13C CPMAS NMR,*j. Agric. Food Chem.*, 1998, pp. 1423-1427, vol. 46.

He et al., "Hydrodeoxygenation of Model Compounds and Catalytic Systems for Pyrolysis Bio-Oils Upgrading," *Catalysis for Sustainable Energy*, 2013, pp. 28-32.

* cited by examiner

TOBACCO-DERIVED PYROLYSIS OIL

FIELD OF THE INVENTION

The present invention relates to products made or derived from tobacco, or that otherwise incorporate tobacco or components of tobacco, and are intended for human consumption. Of particular interest are ingredients or components obtained or derived from plants or portions of plants from the *Nicotiana* species.

BACKGROUND OF THE INVENTION

Cigarettes, cigars, and pipes are popular smoking articles that employ tobacco in various forms. Such smoking articles are employed by heating or burning tobacco to generate aerosol (e.g., smoke) that may be inhaled by the smoker. Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

The tobacco used for cigarette manufacture is typically used in blended form. For example, certain popular tobacco blends, commonly referred to as "American blends," comprise mixtures of flue-cured tobacco, burley tobacco and Oriental tobacco, and in many cases, certain processed tobaccos, such as reconstituted tobacco and processed tobacco stems. The precise amount of each type of tobacco within a tobacco blend used for the manufacture of a particular cigarette brand varies from brand to brand. However, for many tobacco blends, flue-cured tobacco makes up a relatively large proportion of the blend, while Oriental tobacco makes up a relatively small proportion of the blend. See, for example, *Tobacco Encyclopedia*, Voges (Ed.) p. 44-45 (1984), Browne, *The Design of Cigarettes*, 3rd Ed., p. 43 (1990) and *Tobacco Production, Chemistry and Technology*, Davis et al. (Eds.) p. 346 (1999).

Tobacco also may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0025738 to Mua et al.; 2009/0025739 to Brinkley et al.; 2009/0065013 to Essen et al.; 2009/0293889 to Kumar et al.; 2010/0018540 to Doolittle et al; 2010/0018541 to Gerardi et al.; 2010/0291245 to Gao et al; 2011/0139164 to Mua et al.; 2011/0174323 to Coleman, III et al.; 2011/0247640 to Beeson et al.; 2011/0259353 to Coleman, III et al.; 2012/0037175 to Cantrell et al.; 2012/0055494 to Hunt et al.; 2012/0103353 to Sebastian et al.; 2012/0125354 to Byrd et al.; 2012/0138073 to Cantrell et al.; and 2012/0138074 to Cantrell et al; PCT WO 04/095959 to Arnarp et al.; PCT WO 05/063060 to Atchley et al.; PCT WO 05/004480 to Engstrom; PCT WO 05/016036 to Bjorkholm; PCT WO 05/041699 to Quinter et al., and PCT WO 10/132,444 to Atchley; each of which is incorporated herein by reference.

One type of smokeless tobacco product is referred to as "snuff" Representative types of moist snuff products, commonly referred to as "snus," have been manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard. Representative smokeless tobacco products also have been marketed under the tradenames Oliver Twist by House of Oliver Twist A/S; Copenhagen moist tobacco, Copenhagen pouches, Skoal Bandits, Skoal Pouches, SkoalDry, Rooster, Red Seal long cut, Husky, and Revel Mint Tobacco Packs by U.S. Smokeless Tobacco Co.; Marlboro Snus and "taboka" by Philip Morris USA; Levi Garrett, Peachy, Taylor's Pride, Kodiak, Hawken Wintergreen, Grizzly, Dental, Kentucky King, and Mammoth Cave by American Snuff Company, LLC; Camel Snus, Camel Orbs, Camel Sticks, and Camel Strips by R. J. Reynolds Tobacco Company. Other exemplary smokeless tobacco products that have been marketed include those referred to as Kayak moist snuff and Chatanooga Chew chewing tobacco by Swisher International, Inc.; and Redman chewing tobacco by Pinkerton Tobacco Co. LP.

Through the years, various treatment methods and additives have been proposed for altering the overall character or nature of tobacco materials utilized in tobacco products. For example, additives or treatment processes have been utilized in order to alter the chemistry or sensory properties of the tobacco material, or in the case of smokable tobacco materials, to alter the chemistry or sensory properties of mainstream smoke generated by smoking articles including the tobacco material. The sensory attributes of cigarette smoke can be enhanced by incorporating flavoring materials into various components of a cigarette. Exemplary flavoring additives include menthol and products of Maillard reactions, such as pyrazines, aminosugars, and Amadori compounds. American cigarette tobacco blends typically contain a casing composition that includes flavoring ingredients, such as licorice or cocoa powder and a sugar source such as high fructose corn syrup. See also, Leffingwell et al., *Tobacco Flavoring for Smoking Products*, R. J. Reynolds Tobacco Company (1972), which is incorporated herein by reference. In some cases, treatment processes involving the use of heat can impart to the processed tobacco a desired color or visual character, desired sensory properties, or a desired physical nature or texture. Various processes for preparing flavorful and aromatic compositions for use in tobacco compositions are set forth in U.S. Pat. No. 3,424,171 to Rooker; U.S. Pat. No. 3,476,118 to Luttich; U.S. Pat. No. 4,150,677 to Osborne, Jr. et al.; U.S. Pat. No. 4,596,259 to White et al.; U.S. Pat. No. 4,986,286 to Roberts et al.; U.S. Pat. No. 5,074,319 to White et al.; U.S. Pat. No. 5,099,862 to White et al.; U.S. Pat. No. 5,235,992 to Sensabaugh, Jr.; U.S. Pat. No. 5,301,694 to Raymond et al.; U.S. Pat. No. 6,298,858 to Coleman, III et al.; U.S. Pat. No. 6,325,860 to Coleman, III et al.; U.S. Pat. No. 6,428,624 to Coleman, III et al.; U.S. Pat. No. 6,440,223 to Dube et al.; U.S. Pat. No. 6,499,489 to Coleman, III; and U.S. Pat. No. 6,591,841 to White et al.; US Pat. Appl. Pub. Nos. 2004/0173228 to Coleman, III and 2010/0037903 to Coleman, III et al., each of which is incorporated herein by reference.

The sensory attributes of smokeless tobacco can also be enhanced by incorporation of certain flavoring materials. See, for example, US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

It would be desirable to provide additional compositions and methods for altering the character and nature of tobacco (and tobacco compositions and formulations) useful in the manufacture of smoking articles and/or smokeless tobacco products. Specifically, it would be desirable to develop compositions and methods for altering the character and nature of tobacco compositions and formulations using tobacco-derived flavorful materials.

SUMMARY OF THE INVENTION

The present invention provides materials from *Nicotiana* species (e.g., tobacco-derived materials) comprising mixtures and/or isolated components from plants of the *Nicotiana* species useful for incorporation into tobacco compositions utilized in a variety of tobacco products, such as smoking articles and smokeless tobacco products. The invention also provides methods for isolating components from *Nicotiana* species (e.g., tobacco materials), and methods for processing those components and tobacco materials incorporating those components.

In particular, the invention provides tobacco-derived compositions that, in some embodiments, comprise one or more flavorful components. In some embodiments, the flavorful components comprise phenolic compounds. The tobacco-derived compositions can thus be used, in some embodiments, as a flavor ingredient for addition to, e.g., smoking products, smokeless tobacco products, and e-cigarettes. Such tobacco-derived compositions can, for example, provide sweet and/or smoky sensory characteristics to the material to which they are added.

In one aspect of the present invention is provided a method of providing a tobacco-derived pyrolysis oil, comprising: obtaining a tobacco material; pyrolyzing the tobacco material to produce char and a vapor product; and condensing and collecting the vapor product to give a tobacco-derived pyrolysis oil. The tobacco material can comprise, for example, tobacco stalks or tobacco roots, which can optionally be in the form of a powder. In certain embodiments, the pyrolyzing is conducted at a temperature of at least about 400° C., e.g., between about 400° C. and about 450° C. The pyrolyzing can be conducted under various conditions. In one embodiment, the pyrolyzing is done under a nitrogen atmosphere.

According to certain embodiments, the method can further comprise incorporating the tobacco-derived pyrolysis oil into a tobacco product selected from the group consisting of smoking articles, smokeless tobacco products, and electronic smoking articles. In some embodiments, the method can further comprise adding the tobacco-derived pyrolysis oil (or a single component or mixture of components derived from the tobacco-derived pyrolysis oil) to a tobacco material or a non-tobacco plant material as a carrier for the tobacco-derived pyrolysis oil (or derivative thereof). The tobacco material or non-tobacco plant material can, in some embodiments, then be incorporated into a tobacco product.

In some embodiments, the method can further comprise isolating a single component or mixture of components from the tobacco-derived pyrolysis oil. One exemplary means for isolating a single component or mixture of components comprises subjecting the tobacco-derived pyrolysis oil to flash chromatography. The resulting single components or combinations thereof can, in certain embodiments, comprise at least one of: vanillin, acetovanillin, guaiacol, and 2,6-dimethoxyphenol.

In another aspect of the invention is provided a tobacco-derived pyrolysis oil, wherein the tobacco-derived pyrolysis oil comprises less than about 100 ppm benzo[a]pyrene. For example, in certain embodiments, the tobacco-derived pyrolysis oil comprises less than about 10 ppm benzo[a]pyrene. Advantageously, the tobacco-derived pyrolysis oil may exhibit desirable sensory characteristics, such as a sweet or smoky aroma.

The makeup of the tobacco-derived pyrolysis oil can vary. For example, in some embodiments, the tobacco-derived pyrolysis oil comprises furfural and one or more methoxy phenols. In certain embodiments, the tobacco-derived pyrolysis oil comprises at least one of: vanillin, acetovanillin, guaiacol, and 2,6-dimethoxyphenol. In some embodiments, the tobacco-derived pyrolysis oil comprises less than about 10% by weight of each of: cresol, phenol, xylene, and methyl phenols. In some embodiments, the tobacco-derived pyrolysis oil comprises less than about 20% by weight of cresol, phenol, xylene, and methyl phenols combined.

In a further aspect of the invention is provided a tobacco product incorporating a tobacco-derived pyrolysis oil as described herein. The form of the tobacco product can be, for example, in the form of a smoking article, an electronic smoking article, or a smokeless tobacco product, e.g., selected from the group consisting of moist snuff, dry snuff, chewing tobacco, tobacco-containing gums, and dissolvable or meltable tobacco products.

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION OF THE PREFERRED EMBODIMENTS

Figure 1:
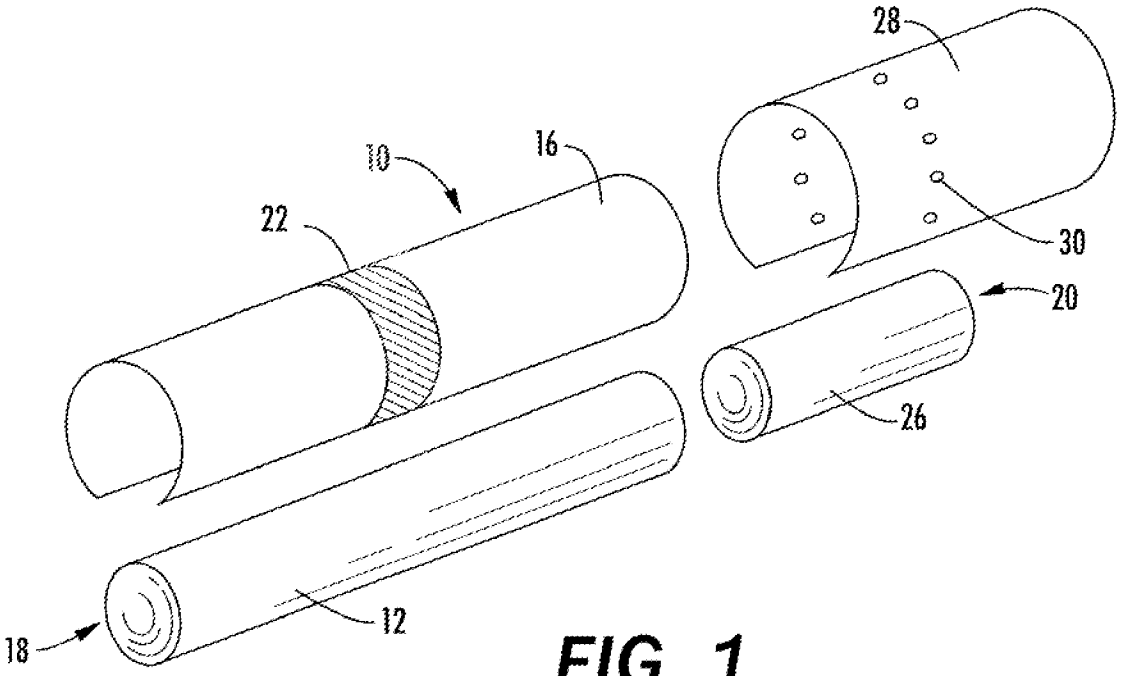
FIG. 1 is an exploded perspective view of a smoking article having the form of a cigarette, showing the smokable material, the wrapping material components, and the filter element of the cigarette.

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The present invention provides compositions derived from tobacco materials. Specifically, the invention provides pyrolysis oils derived from tobacco materials. The oils described herein can be derived from any portion of a plant of the *Nicotiana* species and are, in some embodiments, specifically derived from stalks and/or roots of plants of the *Nicotiana* species. Such oils can have various compositions and, in some embodiments, comprise one or more components that provide desirable sensory characteristics to the oil. As used herein, "pyrolysis oil" or "py-oil" refers to the condensable portion of the gaseous product resulting from pyrolysis of a biomass. Pyrolysis oils referred to herein as "tobacco-derived" encompass any pyrolysis oil resulting from pyrolysis of a plant of the *Nicotiana* species. Although the disclosure refers to "oils," it is noted that the oils can be provided in various forms, e.g., diluted to a solution form or concentrated or dried to a solid or semi-solid form. The disclosure also provides methods of providing such oils and tobacco products comprising such oils.

The products of the disclosure incorporate some form of a plant of the *Nicotiana* species, and most preferably, those compositions or products incorporate some form of tobacco. The selection of the plant from the *Nicotiana* species can vary; and in particular, the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. *Nicotiana* species can be derived using genetic-modification or crossbreeding techniques (e.g., tobacco plants can be genetically engineered or crossbred to increase or decrease production of or to other change certain components, characteristics or attributes). Additional information on types of *Nicotiana* species suitable for use in the present invention can be found in US Pat. Appl. Pub. No. 2012/0192880 to Dube et al., which is incorporated by reference herein. Tobacco plants can be grown in greenhouses, growth chambers, or outdoors in fields, or grown hydroponically.

The *Nicotiana* species can be selected for the content of various compounds that are present therein. For example, plants can be selected on the basis that those plants produce relatively high quantities of one or more of the compounds desired to be isolated therefrom. The portion or portions of the plant of the *Nicotiana* species used according to the present invention can vary. For example, virtually all of the plant (e.g., the whole plant) can be harvested, and employed as such. Alternatively, various parts or pieces of the plant can be harvested or separated for further use after harvest. For example, the leaves, stem, stalk, roots, lamina, flowers, seed, and various portions and combinations thereof, can be isolated for further use or treatment. The plant material of the invention may thus comprise an entire plant or any portion of a plant of the *Nicotiana* species. See, for example, the portions of tobacco plants set forth in US Pat. Appl. Pub. Nos. 2011/0174323 to Coleman, III et al. and 2012/0192880 to Dube et al., which are incorporated by reference herein.

Advantageously according to the present invention, the portion of the *Nicotiana* plant selected for use according to the methods described herein (i.e., to be processed to provide a pyrolysis oil) is selected such that it is believed to comprise at least some, and preferably a significant amount of, cellulose. Cellulose is understood to be a polysaccharide of the formula $(C_6H_{10}O_5)_n$, wherein n can be a number from about 10 to over 10,000. In plants (e.g., plants of the *Nicotiana* species), cellulose is commonly found in a mixture with hemicellulose, lignin, pectin, and other substances. For example, analysis of green tobacco stalks has revealed the presence of cellulose, hemi-cellulose, lignin, pectin, and sugars. Tobacco stalks also typically comprise a significant amount of water. For example, the water content of a tobacco stalk may range from about 25% to about 90%, about 50% to about 80%, or about 60% to about 80% by weight.

Although the present disclosure focuses on tobacco stalks, the methods and materials described herein are not limited in application to tobacco stalks. In certain embodiments, stalks are preferably employed as they are commonly considered to be a waste product, and are often discarded upon harvesting the tobacco plant. Furthermore, stalks are known to contain a reasonable amount of cellulose, although the amount of cellulose in a tobacco stalk may vary. However, any portion of a tobacco plant that contains or is expected to contain cellulose can be used. Other exemplary portions of a tobacco plant that are particularly useful according to the methods described herein include roots and stems of *Nicotiana* plants. In some embodiments, leaves/laminae may also be employed as they have been shown to contain some level of cellulose. See, e.g., Hall and Wooten, Quantitative Analysis of Cellulose in Tobacco by $^{13}C$ CPMAS NMR, *J. Agric. Food. Chem.* 1998, 46: 1423-1427, which is incorporated herein by reference.

Where the method employs stalks, entire stalks or only portions of the stalks may be used in the process. The stalks may be directly processed in harvested form or may be physically altered by shredding or chopping prior to pyrolysis. As an alternative, the tobacco stalks may be prepared using a method by which the fibrous structure of the stalk rind surrounding the pith is used and the pith itself is isolated for another purpose. For example, a splitter device can be used to separate the rind from the pith. See, for example, U.S. Pat. Nos. 3,424,611, 3,424,612, and 3,464,877 to Miller et al.; U.S. Pat. No. 4,151,004 to Vukelic; and U.S. Pat. Nos. 3,567,510, 3,976,498, and 4,312,677 to Tilby et al., each of which is incorporated herein by reference. These references describe splitting methods to separate sugar cane into its individual parts, which may be adapted for use with tobacco stalks in accordance with the present invention. Thus, in some embodiments, only the separated rind (rather than the entire tobacco stalk itself) is processed by pyrolysis as provided herein. It is to be understood that reference to processing "stalks" is also intended to encompass processing portions of stalks, e.g., separated rind components.

The plant of the *Nicotiana* species from which the stalk (or other portion thereof) is obtained for use according to the methods described herein can be in either an immature or mature form, and can be used in either a green form or a cured form, as described in 2012/0192880 to Dube et al., which is incorporated by reference herein. The harvested plant material can be subjected to various treatment processes such as, refrigeration, freezing, drying (e.g., freeze-drying or spray-drying), irradiation, yellowing, heating, cooking (e.g., roasting, frying or boiling), fermentation, bleaching or otherwise subjected to storage or treatment for later use. Exemplary processing techniques are described, for example, in US Pat. Appl. Pub. Nos. 2009/0025739 to Brinkley et al. and 2011/0174323 to Coleman, III et al., which are incorporated by reference herein.

At least a portion of the plant of the *Nicotiana* species can be treated with enzymes and/or probiotics before or after harvest, as discussed in U.S. patent application Ser. No. 13/444,272 to Marshall et al., filed on Apr. 11, 2012 and U.S. patent application Ser. No. 13/553,222 to Moldoveanu, filed on Jul. 19, 2012, which are incorporated herein by reference.

A harvested portion or portions of the plant of the *Nicotiana* species can be physically processed. A portion or portions of the plant can be separated into individual parts or pieces (e.g., roots can be removed from stalks, stems can be removed from stalks, leaves can be removed from stalks and/or stems, petals can be removed from the remaining portion of the flower). In some embodiments, such portions can be used together in unseparated form or can be separated and then combined (e.g., stalks and roots and/or stalks and stems). The harvested portion or portions of the plant can be further subdivided into parts or pieces (e.g., shredded, cut, chipped, comminuted, pulverized, milled or ground into pieces or parts that can be characterized as filler-type pieces, granules, particulates or fine powders). The harvested portion or portions of the plant can be subjected to external forces or pressure (e.g., by being pressed or subjected to roll treatment).

Further, in some embodiments, the harvested portion or portions of the plant can be further processed (e.g., by distillation/fractionation) to provide one component or a mixture of components to be subjected to pyrolysis. For example, in some embodiments, harvested tobacco plant material can be processed to provide lignin and the lignin is subjected to pyrolysis. Methods for obtaining lignin from tobacco plants are described, for example, in Ralph et al., *Proc. Natl. Acad. Sci. U.S.A.* 95(22): 12803-12808 (1998), which is incorporated herein by reference.

In some embodiments, the ash content of the harvested portion or portions of the *Nicotiana* plant is advantageously decreased for use according to the methods described herein. Various means can be employed for decreasing the ash content of a tobacco material. In some embodiments, the growing conditions (e.g., the region in which a tobacco plant is grown) can affect the ash content of a plant. For example, tobaccos grown in coastal regions tend to have high sodium content, presumably from salt in the air, water, and soil. In one embodiments, a feedstock hot water wash of the harvested *Nicotiana* plant portions can be conducted prior to use. In some embodiments, the method of harvest can provide the harvested *Nicotiana* plant portions in a decreased ash form. For example, in certain embodiments, the ash content may be higher in root than in stalk and thus, in some embodiments, it may be preferable to harvest and use a higher percentage of stalk to alter the stalk to root ratio and thus decrease the total composite ash.

According to the present disclosure, the harvested portion or portions of a plant of the *Nicotiana* species is pyrolyzed to provide a tobacco-derived py-oil. Pyrolysis is a process of heating a material at elevated temperature, typically in the absence of oxygen to decompose organic materials therein. Generally with pyrolysis, a plant or portions thereof is heated in an oxygen-free environment to a carefully controlled, desired temperature (typically sufficient to release and/or form various gaseous volatile and/or vaporous pyrolysis products). The volatile products thus released and/or formed are quickly cooled from gaseous form (i.e., condensed into liquid form) and collected (to give the py-oil). In addition to forming a py-oil, pyrolysis typically produces some non-condensable, combustible pyrolysis gases and a char component. As used herein, pyrolysis can encompass such methods as conventional pyrolysis, vacuum pyrolysis, and flash pyrolysis.

The pyrolysis can be conducted in various ways. For exemplary means by which pyrolysis can be conducted and exemplary conditions for pyrolysis, see for example, U.S. Pat. No. 3,106,473 to Hollenbeck et al.; U.S. Pat. No. 3,330,669 to Hollenbeck, and U.S. Pat. No. 4,596,259 to White et al.; and US Pat. Appl. Publ. No. 2011/034712 to Lin et al., which are all incorporated herein by reference.

In some embodiments, a fluidized bed reactor can be used to conduct the pyrolysis process, wherein tobacco biomass particles (e.g., ground tobacco stalk) are introduced into a bed of hot sand fluidized by a gas, which results in rapid heating of the biomass particles. In some embodiments, a circulating fluidized bed reactor is used, wherein the bed of hot sand into which the biomass particles are introduced is circulating. In other embodiments, a rotary kiln system, rotating cone, or rotary hearth unit can be used to conduct the pyrolysis, where solids are mixed and transported into the reactor by a rotating action. In some embodiments, augers can be used, wherein hot sand and the biomass to be pyrolyzed are fed into one end of a screw, which mixes the sand and biomass and conveys them along into the reactor. Within a given reactor or pyrolysis system, heat can be applied to the tobacco plant component(s) directly or indirectly.

In one particular embodiment, a feed system equipped with an agitator and augers deliver a regulated flow of the tobacco biomass to a reactor unit. In the reactor unit, an inert transport gas (e.g., nitrogen) is used to bring a regulated flow of hot sand into contact with the biomass. As the biomass mixes with the hot sand, it is broken down into a pyrolytic vapor and unconverted biomass becomes a powdery char. The pyrolytic vapor is separated from the sand and char in a cyclonic separator, and then travels through the system to a py-oil collection system. In the collection system, the vapor is quickly quenched and condensed product can be drawn continuously from the system.

Various commercial facilities are in operation that produce pyrolysis oils, including Ensyn Technologies, Inc. (Canada) and Dynamotive Inc. (Canada) and smaller facilities including American Science and Technology Corporation (Illinois, USA), the Biomass Technology Group of the Netherlands (Malaysia), the VTT Technical Research Center (Finland), the Canada Center for Mineral and Energy Technology (Canada), and the National Renewable Energy Laboratory (United States), and Pytec Technologies (Germany).

As noted, pyrolysis typically produces volatile organic compounds (condensed to provide the py-oil), non-condensable pyrolysis gases, and char. The percentage of each material produced can depend, for example, on the pyrolysis method, the characteristics of the biomass pyrolyzed, and also on the reaction parameters (e.g., temperature, rate of heating, time of heating, degree of mixing, feed rate of biomass, pressure, and flow rate of gas, etc.). In certain embodiments, various reaction parameters are varied and can be optimized to maximize the yield of py-oil. For example, the temperature at which the pyrolysis is conducted can vary. The temperatures are typically at least about 350° C., at least about 375° C., at least about 400° C., or at least about 425° C. Typical temperatures for pyrolysis can range from about 400° C. to about 600° C. In certain embodiments, the temperature can be on the lower end of this range, e.g., between about 400° C. and about 450° C., such as in some embodiments, at about 425° C. The residence time of the biomass within the reactor can also vary, from seconds to hours within the reactor (e.g., between about 10 seconds and about 10 hours, e.g., between about 1 and about 5 hours). Other parameters that can affect the products of the pyrolysis process and/or the yield thereof include the heating rate, the pressure, and the degree of mixing. The heating rate typically is relatively fast. For 'fast pyrolysis,' the tobacco material is introduced into a preheated pyrolysis zone that is already at temperature, so the material should heat very quickly, e.g., on the order of seconds (including less than about 5 minutes, less than about 1 minute, less than about 30 seconds, less than about 20 seconds, less than about 10 seconds, and less than about 5 seconds). Advantageously, the degree of mixing is relatively high so that all of the material introduced into the pyrolysis zone is subjected to the same amount of heat in the same amount of time. Typically, uniform and consistent heating of the material is provided. The pressure is typically not controlled, but is kept at a relatively low value.

The desirable volatile organic components are typically condensed (in a single condenser or a series of condensers associated with the reactor) to provide the pyrolysis oil. The medium used to quench the volatile organic vapors can vary and may be, for example, a medium comprising water and/or or a non-polar, immiscible liquid (e.g., collected py-oil itself). In certain embodiments, water may be a desirable quenching medium, as it is unlikely to affect the flavor and/or sensory characteristics of the py-oil thus obtained. The condensed py-oil is commonly filtered to remove ash and/or other possible contaminants and solids therefrom such that, in preferred embodiments, the py-oil of the present invention comprises virtually only condensible materials from the pyrolysis process, in substantially pure form (e.g., free of non-condensible, particulate matter).

Although the present disclosure focuses on the production and collection of py-oil, the other products of the pyrolysis can, in some embodiments, be useful. For example, in certain embodiments, the char can be isolated and used (e.g., the char can be gasified to produce ash, which may be used in such applications as fertilizer, as it may contain high concentrations of potassium and/or phosphorus). In certain embodiments, the char and/or the gases produced in the pyrolysis process can be reused in the process to provide economic benefit to the operation of the pyrolysis system.

The as-produced py-oil can, in some embodiments, contain various chemicals generated from pyrolysis of cellulose, hemicelluloses, and lignin (including, but not limited to, phenolics such as furfurals and methoxy phenols, and sugar-derived chemicals). In certain embodiments, the py-oil can further comprise nitrogen-based chemicals. Certain specific desirable compounds that can be found in the py-oil in certain embodiments include vanillin, acetovanillin, guaiacol, and 2,6-dimethoxyphenol. The overall yield of pyrolysis oil from the tobacco biomass can vary and the yield of individual constituents of the py-oil can also vary. In certain embodiments, the yield of py-oil is at least about 10% by weight, at least about 20% by weight, at least about 30% by weight, at least about 40% by weight, or at least about 50% by weight, based on the total amount of biomass pyrolyzed.

In certain preferred embodiments, the benzo[a]pyrene (B[a]p) content of the py-oil is minimized. For example, in certain embodiments, the py-oil contains less than about 100 ppm B[a]p, less than about 50 ppm B[a]p, or less than about 10 ppm B[a]p. Advantageously, the py-oil contains no detectable amount of B[a]p. Although in some embodiments, B[a]p has been observed in py-oil produced from lignin, the presently disclosed methods can, in some embodiments, surprisingly provide a py-oil produced from cellulosic tobacco material (which contains lignin), which contains little to no B[a]p. Further, the py-oil desirably in some embodiments contains little to no cresol, phenol, furfurals, xylene, and methylphenols (e.g., less than about 2% by weight, less than about 1% by weight, less than about 0.1% by weight, less than about 0.01% by weight, or below detectable limits of one or more of these compounds alone and less than about 5% by weight, less than about 2%, by weight, less than about 1% by weight, less than about 0.1% by weight of these compounds in combination).

The properties of the pyrolysis oil can vary. For example, the pH of the as-produced py-oil can range in some embodiments from about 3 to about 5 (e.g., between about 3.5 and about 4.5). Typically, the py-oil has desirable sensory characteristics that can be described in certain embodiments as smoky, sweet, and/or reminiscent of vanilla. After production and isolation of the pyrolysis oil, it can, in some embodiments, be employed directly in a range of applications (e.g., as is, or in a diluted or concentrated form). Methods for dilution and concentration are known to one of skill in the art. For example, the liquid can be processed in a manner adapted to concentrate the dissolved or dispersed components of the liquid by removing at least a portion of the solvent (e.g., water) associated therewith. Removing the solvent or a portion thereof can thus provide a py-oil having an increased concentration of various compounds.

In other embodiments, the pyrolysis oil can be treated so as to provide one or more components contained therein in a more usable (e.g., more concentrated) form. Various compounds or mixtures of compounds from the *Nicotiana* plant or portions thereof can be isolated by the methods provided herein. As used herein, an "isolated component," or "isolate" is a compound or complex mixture of compounds separated from py-oil derived from a plant of the *Nicotiana* species or a portion thereof. The isolated component can be a single compound, a homologous mixture of similar compounds (e.g., isomers of a flavor compound), or a heterologous mixture of dissimilar compounds (e.g., a complex mixture of various compounds of different types, preferably having desirable sensory attributes). See, for example, the description of isolated tobacco components and techniques for isolation in US Pat. Appl. Pub. Nos. 2011/0174323 to Coleman, III et al.; 2011/0259353 to Coleman, III et al.; 2012/0192880 to Dube et al.; 2012/0192882 to Dube et al.; and 2012/0211016 to Byrd, Jr. et al., which are incorporated by reference herein.

A desired component or a mixture of desired components can be isolated from a py-oil product by various means. Typical separation processes can include one or more process steps such as solvent extraction (e.g., using polar solvents, organic solvents, or supercritical fluids), chromatography (e.g., preparative liquid chromatography), clarification, distillation, filtration (e.g., ultrafiltration), recrystallization, and/or solvent-solvent partitioning. In some embodiments, plant or portion of the *Nicotiana* species is pre-treated, e.g., to liberate certain compounds to make the desired compounds available for more efficient separation. In some embodiments, multiple methods are used to isolate and/or purify the desired compounds.

In some embodiments, isolated compounds or mixtures thereof can be subjected to conditions so as to cause those compounds to undergo chemical transformation. For example, py-oil obtained from plants of the *Nicotiana* species or portion thereof can be treated to cause chemical transformation of various components therein or be admixed with other ingredients. The chemical transformations or modification of the tobacco material, extract, or isolated compound can result in changes of certain chemical and physical properties of the tobacco material, extract, or isolated compound(s) (e.g., the sensory attributes thereof). Exemplary chemical modification processes can be carried out by acid/base reaction, hydrolysis, oxidation, heating and/or enzymatic treatments; and as such, compounds can undergo various degradation reactions. Exemplary chemical transformation techniques are set forth in US Pat. Appl. Pub. Nos. 2011/0174323 to Coleman, III, et al. and 2011/0259353 to Coleman, III et al., which are incorporated by reference herein.

In one specific embodiment, the py-oil or a portion thereof can be hydrotreated/"upgraded" to produce a liquid hydrocarbon fuel. The hydrotreatment can, for example, comprise hydrodeoxygenation (HDO) of the oil to produce an oil refinery-compatible feedstock or biofuel or production of syngas, which can subsequently be converted to a transportation fuel. In hydrodeoxygenation, pyrolysis oil is treated with hydrogen at elevated pressure in the presence of a catalyst. Catalysts for the HDO process are known in the art and include conventional catalysts similar to those used in petroleum hydrotreating processes such as transition metal sulfides, carbides, nitrides, oxynitrides, phosphides, noble metals, non-precious metals, and metal oxides. Certain exemplary catalysts include, but are not limited to, $CoMo/Al_2O_6$, $CoMoS/Al_2O_6$, $ReS_2/ZrO_2$, and $NiMo/Al_2O_6$. See, e.g., He et al., Catalysis for Sustainable Energy, 28-52 (2013), which is incorporated herein by reference for various catalysts that may be useful for this purpose. In other embodiments, fuel can be produced from pyrolysis oils by, e.g., zeolite upgrading (wherein oxygen is released as $CO_2$ and $H_2O$ at atmospheric pressure and high temperatures of 300° C. to 600° C.).

The py-oil can optionally be subjected to further treatment steps, which can be used in the place of, or in addition to, the other isolation steps described herein. For example, in some embodiments, the py-oil can be brought into contact with an imprinted polymer or non-imprinted polymer such as described, for example, in US Pat. Pub. Nos. 2007/0186940 to Bhattacharyya et al; 2011/0041859 to Rees et al.; and 2011/0159160 to Jonsson et al; and U.S. patent application Ser. No. 13/111,330 to Byrd et al., filed May 19, 2011, all of which are incorporated herein by reference. Treatment with a molecularly imprinted or non-imprinted polymer can be used to remove certain components of the py-oil.

In certain embodiments, solvent extraction is used to isolate a desired component or components from the mixture of components in the py-oil. Exemplary extraction and separation solvents or carriers include water, alcohols (e.g., methanol or ethanol), hydrocarbons (e.g., heptane and hexane), ethers (e.g., diethyl ether and methyl-t-butyl ether), methylene chloride, supercritical carbon dioxide, and combinations thereof. Exemplary techniques useful for extracting components from *Nicotiana* species are described or referenced in US Pat. Appl. Pub. Nos. 2011/0259353 to Coleman, III et al. and 2012/0211016 to Byrd, Jr. et al., which are incorporated by reference herein.

The conditions of such an extraction process can vary. In some embodiments, the py-oil can be combined with one or more solvents to form a mixture or a two-phase system (e.g., where water is added to give one oily layer and one aqueous layer). Various reagents can optionally be added to the extraction solvent. In some embodiments, a processing aid is added to facilitate the extraction. A processing aid is any agent that facilitates the extraction of the desired component(s) into the extraction solvent. For example, suitable processing aids include, but are not limited to, mineral acids and enzymes. Various other additives can be used in the extraction process, including, but not limited to, surfactants and co-solvents.

The mixture or two-phase system can, in some embodiments, be heated at various temperatures and pressures. In certain embodiments, the mixture or two-phase system is heated to elevated temperatures (e.g., above room temperature) to effect extraction of compounds from the py-oil into the added solvent, although in some embodiments, room temperature may be sufficient. In certain embodiments, the pressure and temperature are adjusted such that the temperature is elevated compared to the boiling point of water (or other solvent) at atmospheric pressure. One of skill in the art will be aware that the boiling point of a liquid is related to its pressure, and therefore will be able to adjust the pressure and temperature accordingly to cause boiling of the material. The amount of time required to effectuate extraction is partially dependent on the temperature and pressure at which the extraction is conducted. For example, in some embodiments, heating the material to an elevated temperature and/or pressurizing the material increases the rate of extraction. In some embodiments, multiple extractions can be conducted to extract additional compounds therefrom. See, for example, US Patent App. Publ. No. 2008/0254149 to Havkin-Frenkel, which is incorporated herein by reference.

In certain embodiments, distillation can be used to isolate a desired component or a mixture of desired components from the py-oil. See, for example, the distillation process set forth in US Patent App. Publ. No. 2012/0192882 to Dube et al, which is incorporated by reference herein. Distillation can, in some embodiments, comprise subjecting the py-oil (in diluted or un-diluted form) to a distillation process for a time and at a temperature sufficient to cause the distillation of one or more components of the py-oil. In some embodiments, one or more reagents may be added to the py-oil to facilitate the distillation of desired components. Either the components that are distilled by removal or the distillate, or both, can be used according to the invention. Various types of distillation can be employed, for example, simple distillation, short path distillation, fractional distillation, steam distillation, azeotropic distillation, and/or vacuum distillation.

In some embodiments, multiple sequential separation processes can be employed to purify and refine a py-oil in the desired manner. For example, a solvent extract or distillate can, in some embodiments, be subjected to additional separation steps to change the chemical composition of the extract or distillate, such as by increasing the relative amount of certain desirable compounds, such as certain flavorful or aromatic compounds. In some embodiments, an extract or distillate can be treated by filtration. As another example, one of the processes noted above (e.g., solvent extraction or distillation) may be combined with one or more chromatographic methods. In some embodiments, a sample is first treated to remove one or more compounds that are known to elute under similar conditions as the compound(s) to be isolated by flash chromatography. In other embodiments, a sample can be dissolved and directly subjected to chromatographic separation.

In some embodiments, preparative liquid chromatography is used to isolate and/or purify certain compounds of interest from a py-oil or derivative thereof. In some embodiments, a compound or compounds of interest are isolated using preparative liquid chromatography based on the elution times of standards. Various automated commercial prep-LC systems are available, from manufacturers including Waters, Agilent Technologies, and Bio-Rad. The specific parameters of the prep LC system used can be varied by one of skill in the art to achieve the desired level of resolution. For example, the solvent may be any solvent or mixture of solvents sufficient to dissolve the compound(s) of interest. The solvent may be, for example, water, methanol, ethanol, ethyl acetate, diethyl ether, methylene chloride, chloroform, petroleum ether, and/or hexanes. The system may be operated with an isocratic or gradient solvent system (i.e., varying the ratio of two or more solvents as a function of time). In some embodiments, the solvent system can be chosen such that it provides the best resolution between the compound of interest and other compounds present in the mixture. The flow rate of the system may be varied, for example, from about 10 mL/min to about 100 mL/min (e.g., about 36 mL/min).

In some embodiments, flash chromatography is used to isolate and/or purify certain compounds of interest from a py-oil or derivative thereof. Flash chromatography systems are known in the art and exemplary systems are discussed, for example, in Still et al., J. Org. Chem. 42: 2923-2925 (1978) and U.S. Pat. No. 4,591,442 to Andrews, which are incorporated herein by reference. Various automated commercial flash chromatography systems are available, from manufacturers including Biotage, Teledyne Isco, Grace Davison Discovery Sciences, and Buchi. Flash chromatography may be desirable to provide reasonably large quantities of compound, as columns typically have relatively large particle sizes (e.g., roughly 30-40 μm) and can accommodate a greater quantity of sample (and a more concentrated sample), allowing more of the compound(s) of interest to be isolated per injection.

The specific parameters of the flash chromatography system used can be varied by one of skill in the art to achieve the desired level of resolution. For example, the solvent may be any solvent or mixture of solvents sufficient to dissolve the compound(s) of interest. The solvent may be, for example, water, methanol, ethanol, ethyl acetate, diethyl ether, methylene chloride, chloroform, petroleum ether, and/or hexanes. The system may be operated with an isocratic or gradient solvent system (i.e., varying the ratio of two or more solvents as a function of time). In some embodiments, the solvent system may be chosen to provide the best resolution between the compound of interest and other compounds present in the mixture. The flow rate of the system may be varied, for example, from about 20 to about 200 mL/min (e.g., about 150 mL/min).

Flash chromatography may or may not provide the compound(s) of interest at a sufficient purity level. In certain embodiments, the fractions corresponding to the compound(s) of interest may be collected, combined, and concentrated to give an isolate comprising the compound(s) of interest at a sufficient level of purity (i.e., wherein the compound(s) of interest are present in a sufficient weight percentage of the isolate). In other embodiments, different fractions obtained can be isolated separately and used separately. Isolated fractions of the present invention can comprise the compound(s) of interest in an amount of, for example, greater than about 75% by weight, greater than about 80% by weight, greater than about 85% by weight, greater than about 90% by weight, greater than about 95% by weight, greater than about 98% by weight, or greater than about 99% by weight. In some embodiments, fractions obtained from flash chromatography can be further resolved using preparative liquid chromatography.

In certain embodiments according to the present disclosure, extraction with methyl tert-butyl ether followed by flash chromatography is employed to provide fractions enriched in phenolics that exhibit smoky sensory characteristics (e.g., guaiacol and syringol) and compounds that exhibit brown, nutty, sweet sensory characteristics (e.g., cyclotene, vanillin, and pyrazines).

Various methods of solvent removal can be employed, such as heat treatment to evaporate the solvent, reverse osmosis membrane treatment, spray drying or freeze drying. In one embodiment, the concentration process can entail heating the extracted liquid in a vented vessel to evaporate a portion of the water. The temperature and pressure at which the liquid is heated may vary. See, for example, the solvent removal techniques set forth in US Pat. Pub. No. 2012/0152265 to Dube et al., which is incorporated by reference herein.

The foam of the tobacco py-oil or derivative thereof obtained according to the present invention can vary. Typically, the py-oil or derivative thereof is in a solid, liquid, or semi-solid or gel form. The formulation can be used in concrete, absolute, or neat form. Solid forms of the can include spray-dried and freeze-dried forms. Liquid forms can include formulations contained within aqueous or organic solvent carriers.

Tobacco-derived py-oils, mixtures of components isolated from the py-oils, and individual components isolated from the py-oils thereof generated according to the process of the invention are useful as materials for various compositions. Although the use of such py-oils and components thereof is generally described in the context of tobacco compositions, it is noted that such materials can be applicable in many other types of compositions.

For example, in some embodiments, the tobacco-derived py-oils, mixtures of components isolated from the py-oils, or individual components isolated from the py-oils described herein are incorporated within tobacco compositions, particularly tobacco compositions incorporated into smoking articles or smokeless tobacco products. In accordance with the present invention, a tobacco product incorporates tobacco that is combined with one or more tobacco-derived py-oils, mixtures of components isolated from the py-oils, and/or individual components isolated from the py-oils according to the invention. That is, a portion of the tobacco product can be comprised of some form of py-oil or derivative thereof prepared according to the invention.

Addition of the tobacco py-oil or derivative thereof described herein to a tobacco composition can enhance a tobacco composition in a variety of ways, depending on the nature of the tobacco py-oil or derivative thereof and the type of tobacco composition. Exemplary py-oils or derivatives thereof can serve to provide flavor and/or aroma to a tobacco product (e.g., the composition can alter the sensory characteristics of tobacco compositions or smoke derived therefrom). Advantageously, the tobacco py-oil or derivative thereof can endow the tobacco product with such flavors and/or aromas as: sweet, smoky, vanilla-like, among others. Certain tobacco py-oils or derivatives thereof can serve as a replacement for one or more traditional components of a tobacco product (e.g., flavorants).

The tobacco product to which the tobacco py-oil or derivative thereof described herein is added can vary, and may include any product configured or adapted to deliver tobacco or some component thereof to the user of the product. Exemplary tobacco products include smoking articles (e.g., cigarettes), smokeless tobacco products, and aerosol-generating devices that contain nicotine and/or a tobacco material or other plant material that is not combusted during use. The incorporation of the tobacco py-oils or derivatives thereof of the invention into a tobacco product may involve use of a tobacco material or non-tobacco plant material as a carrier for the oils or derivatives, such as by absorbing the oils and/or derivatives into the tobacco or other plant material or otherwise associating the oils and/or derivatives with the carrier material. The types of tobacco that can serve as the carrier for the formulations of the invention can vary, and can include any of the tobacco types discussed herein, including various cured tobacco materials (e.g., flue-cured or air-cured tobaccos) or portions thereof (e.g., tobacco lamina or tobacco stems). The physical configuration of the tobacco material to which the formulation is added can also vary, and can include tobacco materials in shredded or particulate form, or in the form of a sheet (e.g., reconstituted tobacco sheets) or in whole leaf form.

Accordingly, the tobacco py-oils or derivatives thereof provided herein can, in some embodiments, be used as compositions in the manufacture of smoking articles. For example, the tobacco py-oils or derivatives thereof prepared in accordance with the present invention can be mixed with casing materials and applied to tobacco as a casing ingredient or as a top dressing. Still further, the tobacco py-oils or derivatives thereof of the invention can be incorporated into a cigarette filter (e.g., in the filter plug, plug wrap, or tipping paper) or incorporated into cigarette wrapping paper, preferably on the inside surface, during the cigarette manufacturing process. See, for example, the description and references related to tobacco isolates used in smoking articles set forth in US Pat. Pub. No. 2012/0192880 to Dube et al., which is incorporated by reference herein. Representative tobacco blends, non-tobacco components, and representative cigarettes manufactured therefrom are also set forth in the Dube et al. reference noted above.

Referring to FIG. 1, there is shown a smoking article 10 in the form of a cigarette and possessing certain representative components of a smoking article that can contain the formulation of the present invention. The cigarette 10 includes a generally cylindrical rod 12 of a charge or roll of smokable filler material (e.g., about 0.3 to about 1.0 g of smokable filler material such as tobacco material) contained in a circumscribing wrapping material 16. The rod 12 is conventionally referred to as a "tobacco rod." The ends of the tobacco rod 12 are open to expose the smokable filler material. The cigarette 10 is shown as having one optional band 22 (e.g., a printed coating including a film-forming agent, such as starch, ethylcellulose, or sodium alginate) applied to the wrapping material 16, and that band circumscribes the cigarette rod in a direction transverse to the longitudinal axis of the cigarette. The band 22 can be printed on the inner surface of the wrapping material (i.e., facing the smokable filler material), or less preferably, on the outer surface of the wrapping material.

At one end of the tobacco rod 12 is the lighting end 18, and at the mouth end 20 is positioned a filter element 26. The filter element 26 positioned adjacent one end of the tobacco rod 12 such that the filter element and tobacco rod are axially aligned in an end-to-end relationship, preferably abutting one another. Filter element 26 may have a generally cylindrical shape, and the diameter thereof may be essentially equal to the diameter of the tobacco rod. The ends of the filter element 26 permit the passage of air and smoke therethrough.

A ventilated or air diluted smoking article can be provided with an optional air dilution means, such as a series of perforations 30, each of which extend through the tipping material and plug wrap. The optional perforations 30 can be made by various techniques known to those of ordinary skill in the art, such as laser perforation techniques. Alternatively, so-called off-line air dilution techniques can be used (e.g., through the use of porous paper plug wrap and pre-perforated tipping paper). The formulations of the invention can be incorporated within any of the components of a smoking article, including but not limited to, as a component of the tobacco charge, as a component of the wrapping paper (e.g., included within the paper or coated on the interior or exterior of the paper), as an adhesive, as a filter element component, and/or within a capsule located in any region of the smoking article.

The formulations of the invention can also be incorporated into aerosol-generating devices that contain nicotine and/or tobacco material (or some portion or component thereof) that is not intended to be combusted during use, including so-called "e-cigarettes". Some of these types of smoking articles employ a combustible fuel source that is burned to provide an aerosol and/or to heat an aerosol-forming material. Others employ battery-powered heating elements to heat an aerosol-forming composition. Exemplary references that describe smoking articles of a type that generate flavored vapor, visible aerosol, or a mixture of flavored vapor and visible aerosol, include those set forth in US Pat. Pub. No. 2012/0192880 to Dube et al., which is incorporated by reference herein.

The formulations of the invention can be incorporated into smokeless tobacco products, such as loose moist snuff (e.g., snus); loose dry snuff; chewing tobacco; pelletized tobacco pieces; extruded or formed tobacco strips, pieces, rods, cylinders or sticks; finely divided ground powders; finely divided or milled agglomerates of powdered pieces and components; flake-like pieces; molded tobacco pieces; gums; rolls of tape-like films; readily water-dissolvable or water-dispersible films or strips; meltable compositions; lozenges; pastilles; or capsule-like materials possessing an outer shell and an inner region. Various types of smokeless tobacco products are described or referenced in US Pat. Pub. No 2012/0152265 to Dube et al., which is incorporated herein by reference.

Figure 2:
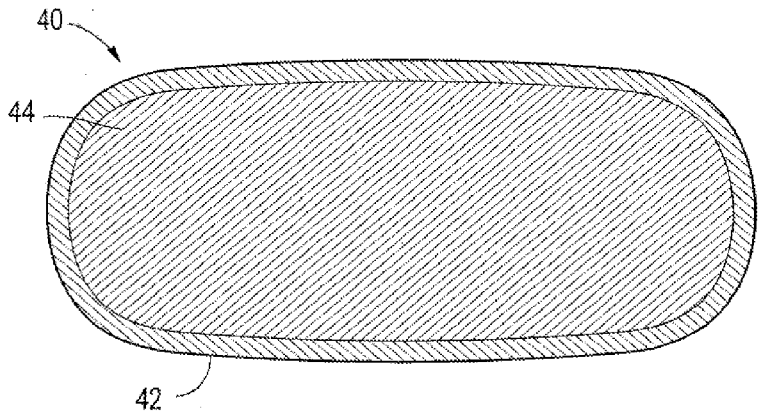
FIG. 2 is a cross-sectional view of a smokeless tobacco product embodiment, taken across the width of the product, showing an outer pouch filled with a smokeless tobacco composition of the invention.

Referring to FIG. 2, a representative snus type of tobacco product comprising a formulation according to the present disclosure is shown. In particular, FIG. 2 illustrates a smokeless tobacco product 40 having a water-permeable outer pouch 42 containing a smokeless tobacco composition 44. Any of the components of the tobacco product can comprise a tobacco py-oil and/or derivative thereof as described herein (e.g., the interior or exterior of the pouch lining or a portion of the smokeless tobacco composition contained therein).

Many exemplary smokeless tobacco compositions that can benefit from use of the formulations of the invention comprise shredded or particulate tobacco material that can serve as a carrier for the tobacco py-oils or derivatives thereof of the invention. The smokeless tobacco compositions of the invention can also include a water-soluble polymeric binder material and optionally other ingredients that provide a dissolvable composition that will slowly disintegrate in the oral cavity during use. In certain embodiments, the smokeless tobacco composition can include lipid components that provide a meltable composition that melts (as opposed to merely dissolving) in the oral cavity, such as compositions set forth in US Pat. Pub. No. 2012/0037175 to Cantrell et al., which is incorporated by reference herein.

In one particular smokeless tobacco product embodiment, a composition of the invention is added to a non-tobacco plant material, such as a plant material selected from potato, beet (e.g., sugar beet), grain, pea, apple, and the like. The non-tobacco plant material can be used in a processed form. In certain preferred embodiments, the non-tobacco plant material can be used in an extracted form, and as such, at least a portion of certain solvent soluble components are removed from that material. The non-tobacco extracted plant material is typically highly extracted, meaning that a substantial amount of the aqueous soluble portion of the plant material has been removed. See, for example, US Pat. Pub. No. 2011/0247640 to Beeson et al, which is incorporated by reference herein.

Further ingredients can be admixed with, or otherwise incorporated within, the smokeless tobacco compositions according to the invention. The ingredients can be artificial, or can be obtained or derived from herbal or biological sources. Exemplary types of ingredients include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), effervescing materials such as certain acid/base combinations, oral care additives (e.g., thyme oil, eucalyptus oil, and zinc), preservatives (e.g., potassium sorbate, and the like), syrups (e.g., honey, high fructose corn syrup, and the like), disintegration aids (e.g., microcrystalline cellulose, croscarmellose sodium, crospovidone, sodium starch glycolate, pregelatinized corn starch, and the like), flavorant and flavoring mixtures, antioxidants, and mixtures thereof. Exemplary encapsulated additives are described, for example, in WO 2010/132444 to Atchley, which has been previously incorporated by reference herein. See also, the smokeless tobacco ingredients set forth in US Pat. Pub. Nos. 2012/0055494 to Hunt et al. and 2012/0199145 to Byrd et al., which are incorporated by reference herein.

Figure 3:
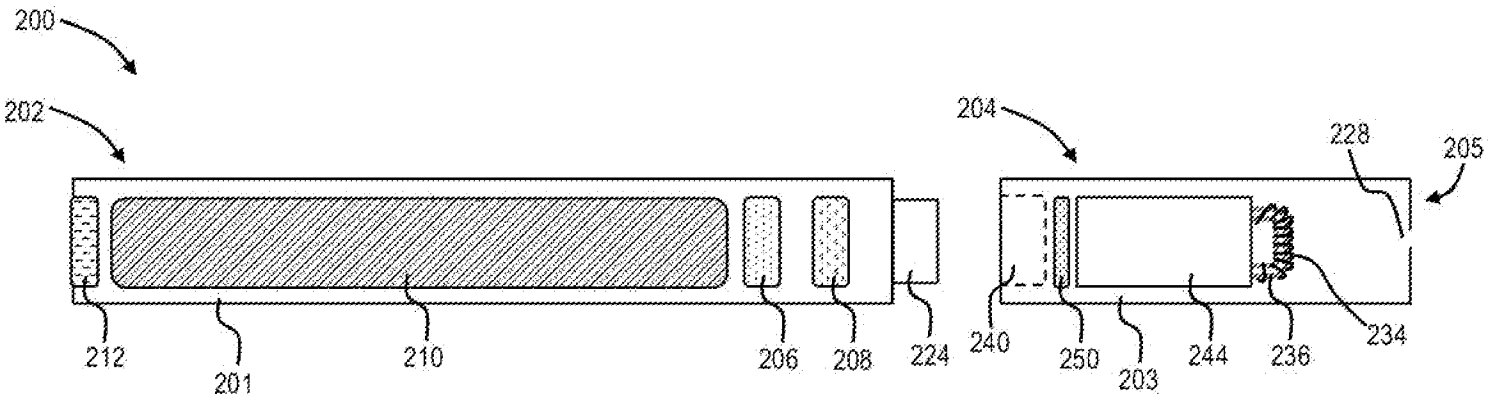
FIG. 3 is a cross-sectional view of an electronic smoking article, which can encompass a variety of combinations of components useful in foaming an electronic aerosol delivery device.

An exemplary embodiment of an electronic smoking article 200 according to the present disclosure is shown in FIG. 3. As illustrated therein, a control body 202 can be formed of a housing 201 that can include a control component 206, a flow sensor 208, a battery 210, and an LED 212. The electronic smoking article also may comprise a cartridge 204 that can be formed of a housing 203 enclosing a reservoir 244 that is in fluid communication with a transport element 236 adapted to wick or otherwise transport an aerosol precursor composition stored in the reservoir to a heater 234 (e.g., a resistive heating wire that may be coiled around at least a portion of the transport element). Exemplary reservoirs and transport elements are disclosed in U.S. patent application Ser. No. 13/802,950, filed Mar. 13, 2013, and exemplary heaters are disclosed in U.S. patent application Ser. No. 13/708,381, filed Dec. 7, 2012, the disclosures of which are incorporated herein by reference in their entireties. An opening 228 may be present in the cartridge housing 203 at a mouthend 205 thereof to allow for egress of formed aerosol from the cartridge 204. Such components are representative of the components that may be present in a control body and/or cartridge and are not intended to limit the scope of components that are encompassed by the present disclosure.

The cartridge 204 may be adapted to engage the control body 202 through a press-fit engagement between the control body projection 224 and the cartridge receptacle 240. Such engagement can facilitate a stable connection between the control body 202 and the cartridge 204 as well as establish an electrical connection between the battery 210 and control component 206 in the control body and the heater 234 in the cartridge. Other types of connections (e.g., a screw thread connection) also are encompassed. The electronic smoking article 200 may be adapted for air intake, which may be provided in a coupler as described, for example, in U.S. patent application Ser. No. 13/841,233, filed Mar. 15, 2013, the disclosure of which is incorporated herein by reference in its entirety. The cartridge 204 also may include one or more electronic components 250, which may include an IC, a memory component, a sensor, or the like. The electronic component 250 may be adapted to communicate with the control component 206 so as to provide an input. See, for example, U.S. patent application Ser. No. 13/647,000, filed Oct. 8, 2012, and U.S. Pat. App. Ser. No. 13/826,929, filed Mar. 14, 2013, the disclosures of which are incorporated herein by reference in their entirety.

The electronic smoking article can encompass a variety of combinations of components useful in forming an electronic aerosol delivery device. Reference is made for example to the following: a reservoir and heater system for controllable delivery of multiple aerosolizable materials disclosed in U.S. patent application Ser. No. 13/536,438, filed Jun. 28, 2012; microheaters as disclosed in U.S. patent application Ser. No. 13/602,871, filed Sep. 4, 2012; carbon-based cartridges and components thereof, as disclosed in U.S. patent application Ser. No. 13/432,406, filed Mar. 28, 2012; single-use cartridges as disclosed in U.S. patent application Ser. No. 13/603,612, filed Sep. 5, 2012; aerosol precursor transport elements, such as disclosed in U.S. patent application Ser. No. 13/754,324, filed Jan. 30, 2013; charging components, such as an adaptor disclosed in U.S. patent application Ser. No. 13/840,264, filed Mar. 15, 2013; vibration components, such as disclosed in U.S. patent application Ser. No. 13/946,309, filed Jul. 19, 2013; and batteries, such as disclosed in U.S. Pat. App. Pub. No. 2010/0028766. The aerosol precursor composition can comprise, for example, a polyhydric alcohol, water, nicotine, and a flavorant (e.g., menthol, as well as the py-oil or derivative thereof of the present invention). Representative types of aerosol precursor compositions are set forth in U.S. Pat. No. 4,793,365 to Sensabaugh, Jr. et al.; U.S. Pat. No. 5,101,839 to Jakob et al.; U.S. Pat. Pub. No. 2013/0008457 to Zheng et al.; and Chemical and Biological Studies on New Cigarette Prototypes that Heat Instead of Burn Tobacco, R. J. Reynolds Tobacco Company Monograph (1988). The disclosures of all of the foregoing documents are incorporated herein by reference in their entireties.

The amount of the tobacco py-oil or derivative thereof incorporated within a tobacco composition or tobacco product can depend on the desired function of the oil or derivative, the chemical makeup of the oil or derivative, and the type of tobacco composition to which the oil or derivative is added. The amount of tobacco oil or derivative added to a tobacco composition can vary, but will typically not exceed about 50 weight percent based on the total dry weight of the tobacco composition to which the composition is added. For example, the amount of tobacco oil or derivative added to a tobacco composition may be in the range of about 025 to about 25 weight percent or about 1 to about 10 weight percent, based on the total dry weight of the tobacco composition.

EXPERIMENTAL

Aspects of the present invention is more fully illustrated by the following examples, which are set forth to illustrate certain aspects of the present invention and are not to be construed as limiting thereof.

Example 1

Bench Scale Pyrolysis of Tobacco

Tobacco feedstock (ground tobacco stalk or ground tobacco root) is fed into a transported bed reactor, wherein an electrical heat tracing system is used to supply heat to sand and nitrogen transport gas. Preheated sand is transferred to the reactor using an auger and is transported up the reactor using the carrier gas, where it contacts the incoming feedstock (tobacco material) and vaporizes the feedstock. The sand, vapor, char, and gas pass through a primary separation unit (cyclone), where the sand is recovered. The char, gas, and vapor exit the cyclone and pass through two additional solids separation units to recover the char and the gas and vapor are separated in a liquid recovery system (by direct contact with a condensing medium, e.g., water, to ensure no external flavors are imparted to the product).

The reactor is run at a higher temperature for tobacco root samples (551.5° C.) than for tobacco stalk samples (503.5° C.), due to the expectation that roots are more likely to contain high molecular weight compounds. For the tobacco stalk samples, the pressure is 2.6 psig, the condenser temperature is 16.8° C., the reactor residence time is 221.4 ms, the sand to feed ratio is 47:1, the amount fed is 3.1 kg, the average feed rate is 2.1 kg/hr, and the total runtime is 1.47 h. For the tobacco root samples, the pressure is 3.8 psig, the condenser temperature is 17.6° C., the reactor residence time is 221.7 ms, the sand to feed ratio is 41:1, the amount fed is 5.8 kg, the average feed rate is 2.4 kg/hr, and the total runtime is 2.42 h.

The liquid recovery from these runs comprises a large amount of orange watery product ("liquid aqueous fraction") and a thick, viscous black product ("liquid non-aqueous fraction") that are immiscible with one another. Both fractions have smoky sensory characteristics. The B[a]p content of these fractions is very low. Although the liquid aqueous fraction is desirable for use according to many of the methods described herein, the liquid non-aqueous fraction may be useful for certain applications. Scaled moisture and ash free liquid yields for the tobacco feedstocks were 54.3% by weight for the ground tobacco stalk and 42.9% by weight for the ground tobacco root.

Example 2

Pyrolysis of Tobacco Stalk Dust in Auger Facility

Tobacco stalk dust is pyrolyzed under $N_2$ atmosphere in an auger pyrolysis facility. The liquid bio-oil produced in the process is collected in a condenser and maintained at a low temperature. The pH of the bio-oil is in the range of about 3.7-4.2. The overall yield of bio-oil from the tobacco stalk dust is in the range of about 16% to about 39%.

The effect of pyrolysis temperature is studied, and the highest yield (39%) was found to be achieved at lower temperatures (i.e., around 425° C.). It is believed that further optimization of process parameters (e.g., pyrolysis temperature, flow rate, and feed rate) can enhance the yield of bio-oil from tobacco stalk dust further.

The py-oil thus obtained is characterized as having sweet and smoky sensory properties. Gas chromatography (GCMS) is used to evaluate the chemical makeup of the bio-oil thus obtained. The bio-oil was shown to contain several compounds generated by the pyrolysis of cellulose (furan and cyclopentene-based compounds), hemicelluloses (furfural-based compounds), and lignin fractions (phenolic compounds) of the tobacco biomass. Various nitrogen-based chemicals were also identified. Notably, the B[a]p content of the py-oil is very low. Based on elemental analysis, the chemical formula of the tobacco oil can be represented as $C_{2.87}H_{6.32}O_{3.8}N_{0.146}$. Pyrolysis conditions are noted to affect the composition and yield of each component and pyrolysis conditions can likely be tuned to achieve maximum yield of certain components. Boiling point analysis indicates that most of the py-oil components have boiling points of less than about 400° C.

The char produced during the bio-oil production is separately treated by subjecting it to gasification at 825° C. for a few hours in a box furnace under air, during which time the char changed in color from black to light grey. The gasification yields 22.5% ash, which is analyzed by scanning electron microscopy (SEM), energy dispersive x-ray analysis (EDX), and inductively coupled plasma (ICP). The ash is noted by SEM to be more porous than the char and around 50% of the ash is composed of potassium (K), phosphorus (P), chlorine (Cl), and sulfur (S), as detected by EDX and confirmed by ICP.

Example 3

Pyrolysis of Tobacco-Derived Lignin

Tobacco stalks are pulped and lignin is cleanly separated from the tobacco biomass using a fractionation process. Two types of lignin are provided thereby. Distilled lignin is pure lignin obtained after distillation of the liquor resulting from the fractionation process. Precipitated lignin is lignin from the fractionation liquor that is precipitated using CaO and NaOH to produce a lignin salt.

The distilled lignin is ground into small particles and subjected to pyrolysis using a fast pyrolysis unit. The powdered lignin is challenging to insert through the feeder unit as the lignin often melts due to the feeder unit's proximity to the reactor. Accordingly, the lignin is mixed with sand inside the cold reactor and the heat is then increased to a desired temperature to evaporate the lignin and begin the pyrolysis process. Accordingly, only fluidized bed pyrolysis was used, rather than auger pyrolysis (as the feeder temperature is higher than the bubbling bed reactor's feeder). The precipitated lignin salt is filtered and dried before pyrolysis and, unlike the distilled lignin, the lignin salt does not melt under pyrolysis conditions. Accordingly, the lignin salt is continuously injected through the feeder into the pyrolysis reactor.

The pyrolysis is carried out under $N_2$ atmosphere under temperatures ranging from 450° C. to 600° C., and one experiment is carried out at 550° C. under hydrogen for comparison. The liquid bio-oil is collected in condensers and the bio-oil yields are between about 8% and about 24%. The Ca-lignin salt produced about 24.5% py-oil yield.

The lignin py-oil is analyzed by GCMS. Major compounds identified in the lignin py-oil include guaiacol, phenol, o-cresol, m-cresol, and p-cresol. The lignin py-oil is also noted to contain exceptionally high levels of B[a]p, although the exact amount of B[a]p was not measured. The trial run at 600° C. produced much lower levels of all compounds, but otherwise, the temperature range (450° C. to 550° C.), hydrogen or nitrogen atmosphere, and form of lignin has very little effect on the makeup of the lignin-derived py-oil. The lignin bio-oil includes relatively low levels of vanillin, and the highest yield of vanillin was obtained from the distilled lignin under nitrogen at 550° C. The lignin salt did not produce any appreciable yield of vanillin.

Example 4

Extraction and Separation of Burley Stalk Py-Oil

Py-oil produced according to Example 2 is further processed to isolate fractions that possess the reported smoky and sweet sensory properties. In a first trial extraction step, the py-oil is extracted with methyl t-butyl ether (MTBE) and the organic layer is isolated and concentrated. In a second (alternative) trial extraction step, the py-oil is acidified to a pH of 3 using sulfuric acid, extracted with methyl t-butyl ether (MTBE) and then the organic layer is isolated and concentrated. In a third (alternative) trial extraction step, the py-oil is basified to a pH of 8 using sodium bicarbonate, extracted with methyl t-butyl ether (MTBE) and then the organic layer is isolated and concentrated.

Each concentrated organic layer is analyzed by GC-MS and the results are compared with those obtained for the crude py-oil. Decreases in the phenolics content are observed for the acidified and basified materials and accordingly, further studies were conducted using the first trial isolation process. The yield after the MTBE extraction step using the first trial extraction method was 5% on a small (25 mL) scale and 12.3% yield on a larger (1 L) scale. The extracted material resulting from the 1 L extraction is subjected to flash chromatography, where three distinct fractions are isolated, corresponding to: 1) phenol, guaiacol, 4-methylguaiacol, dimethylphenols, 4-ethylphenol, 4-ethylguaiacol, and p-cresol; 2) syringol, 1,2-benzenediol, 4-methyl-1,2-benzenediol, 2-furanmethanol, and 4-methylsyringol; and 3) cyclotene, 3-methoxy-1,2-benzenediol, 1,2-benzenediol, 2,5-dihydro-3,5-dimethyl-2-furanone, vanillin, 2,3-dimethyl-2-cyclopenten-1-one, 3-ethyl-2-cyclopenten-1-one, 2-ethylpyrazine, and 2-ethyl-6-methylpyrazine. These fractions can be isolated and used separately or combined for use together. This processing method allows for the isolation of fractions enriched in smoky phenolics (e.g., guaiacol and syringol) and sweet, brown, nutty compounds (e.g., cyclotene, vanillin, and pyrazines).

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method of providing and using a tobacco-derived pyrolysis oil, comprising:

obtaining a tobacco material;

pyrolyzing the tobacco material to produce char and a vapor product; separating the vapor product from the char;

condensing and collecting the vapor product to give a tobacco-derived pyrolysis oil;

adding the tobacco-derived pyrolysis oil or one or more isolated components of the tobacco-derived pyrolysis oil to a tobacco material or a non-tobacco plant material as a carrier for the tobacco-derived pyrolysis oil; and incorporating the tobacco material or non-tobacco plant material into a tobacco product.

2. The method of claim 1, wherein the tobacco material comprises tobacco stalks or tobacco roots.

3. The method of claim 2, wherein the tobacco stalks or tobacco roots are in the form of a powder.

4. The method of claim 1, wherein the pyrolyzing is conducted at a temperature of at least about 400° C.

5. The method of claim 1, wherein the pyrolyzing is conducted at a temperature between about 400° C. and about 450° C.

6. The method of claim 1, wherein the pyrolyzing is done under a nitrogen atmosphere.

7. The method of claim 1, wherein the tobacco-derived pyrolysis oil exhibits a sweet or smoky aroma.

8. The method of claim 1, wherein the tobacco-derived pyrolysis oil comprises at least one of: vanillin, acetovanillin, guaiacol, and 2, 6-dimethoxyphenol.

9. The method of claim 1, wherein the tobacco-derived pyrolysis oil comprises less than about 10% by weight of each of: cresol, phenol, xylene, furfurals, and methyl phenols.

10. The method of claim 1, wherein the tobacco-derived pyrolysis oil comprises less than about 20% by weight of cresol, phenol, xylene, furfurals, and methyl phenols, combined.

11. The method of claim 1, wherein the tobacco-derived pyrolysis oil comprises less than about 100 ppm benzo[a] pyrene.

12. The method of claim 1, wherein the tobacco-derived pyrolysis oil comprises less than about 10 ppm benzo[a] pyrene.

13. The method of claim 1, further comprising isolating a single component or mixture of components from the tobacco-derived pyrolysis oil.

14. The method of claim 13, wherein the isolating comprises subjecting the tobacco-derived pyrolysis oil to flash chromatography.

15. The method of claim 1, wherein the tobacco product is in the form of a smokeless tobacco product.

16. The method of claim 15, wherein the form of the smokeless tobacco product is selected from the group consisting of moist snuff, dry snuff, chewing tobacco, tobacco-containing gums, and dissolvable or meltable tobacco products.

17. The method of claim 1, wherein the tobacco product is in the form of a smoking article.

18. A method of providing a tobacco-derived pyrolysis oil, comprising:

obtaining a tobacco material;

pyrolyzing the tobacco material to produce char and a vapor product;

condensing and collecting the vapor product to give a tobacco-derived pyrolysis oil; and isolating a single component or mixture of components from the tobacco-derived pyrolysis oil, wherein the one or more components comprise vanillin, acetovanillin, guaiacol, 2, 6-dimethoxyphenol, or a combination thereof.

19. A method of providing and using a tobacco-derived pyrolysis oil, comprising:

obtaining a tobacco material;

pyrolyzing the tobacco material to produce char and a vapor product;

condensing and collecting the vapor product to give a tobacco-derived pyrolysis oil; and incorporating the tobacco-derived pyrolysis oil into a tobacco product selected from the group consisting of a smoking article, a smokeless tobacco product, and an electronic smoking article.

20. The method of claim 19, wherein the tobacco material comprises tobacco stalks or tobacco roots.

21. The method of claim 19, wherein the tobacco stalks or tobacco roots are in the form of a powder.

22. The method of claim 19, wherein the pyrolyzing is conducted at a temperature of at least about 400° C.

23. The method of claim 19, wherein the pyrolyzing is conducted at a temperature between about 400° C. and about 450° C.

24. The method of claim 19, wherein the pyrolyzing is done under a nitrogen atmosphere.

25. The method of claim 19, wherein the tobacco-derived pyrolysis oil exhibits a sweet or smoky aroma.

26. The method of claim 19, wherein the tobacco-derived pyrolysis oil comprises at least one of: vanillin, acetovanillin, guaiacol, and 2, 6-dimethoxyphenol.

27. The method of claim 19, wherein the tobacco-derived pyrolysis oil comprises less than about 10% by weight of each of: cresol, phenol, xylene, furfurals, and methyl phenols.

28. The method of claim 19, wherein the tobacco-derived pyrolysis oil comprises less than about 20% by weight of cresol, phenol, xylene, furfurals, and methyl phenols, combined.

29. The method of claim 19, wherein the tobacco-derived pyrolysis oil comprises less than about 100 ppm benzo[a] pyrene.

30. The method of claim 19, wherein the tobacco-derived pyrolysis oil comprises less than about 10 ppm benzo[a] pyrene.

31. The method of claim 19, further comprising isolating a single component or mixture of components from the tobacco-derived pyrolysis oil.

32. The method of claim 31, wherein the isolating comprises subjecting the tobacco-derived pyrolysis oil to flash chromatography.

33. A tobacco product incorporating a tobacco-derived pyrolysis oil comprising less than about 100 ppm benzo[a] pyrene, wherein the product is selected from the group consisting of a smoking article, a smokeless tobacco product, and an electronic smoking article.

34. The tobacco product of claim 33, wherein the product is a smokeless tobacco product selected from the group consisting of moist snuff, dry snuff, chewing tobacco, tobacco-containing gums, dissolvable tobacco products, and meltable tobacco products.

* * * * *